US007344391B2

(12) United States Patent
Minich

(10) Patent No.: US 7,344,391 B2
(45) Date of Patent: Mar. 18, 2008

(54) EDGE AND BROADSIDE COUPLED CONNECTOR

(75) Inventor: Steven E. Minich, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/367,784

(22) Filed: Mar. 3, 2006

(65) Prior Publication Data

US 2007/0207675 A1 Sep. 6, 2007

(51) Int. Cl.
*H01R 13/648* (2006.01)

(52) U.S. Cl. ..... 439/108; 439/608

(58) Field of Classification Search ..... 439/941, 439/108, 607–608
See application file for complete search history.

(56) References Cited

U.S. PATENT DOCUMENTS

| | | | | |
|---|---|---|---|---|
| 2,664,552 | A | 12/1953 | Ericsson et al. | 339/192 |
| 3,115,379 | A | 12/1963 | McKee | 439/290 |
| 3,827,005 | A | 7/1974 | Friend | 339/258 |
| 4,030,792 | A | 6/1977 | Fuerst | 339/17 |
| 4,898,539 | A | 2/1990 | Glover et al. | 439/81 |
| 4,900,271 | A | 2/1990 | Colleran et al. | 439/595 |
| 5,004,426 | A | 4/1991 | Barnett | 439/82 |
| 5,575,688 | A | 11/1996 | Crane, Jr. | 439/660 |
| 5,634,821 | A | 6/1997 | Crane, Jr. | 439/660 |
| 5,637,019 | A | 6/1997 | Crane, Jr. et al. | 439/677 |
| 5,980,321 | A | 11/1999 | Cohen et al. | 439/608 |
| 6,116,926 | A | 9/2000 | Ortega et al. | 439/108 |
| 6,179,663 | B1 | 1/2001 | Bradley et al. | 439/608 |
| 6,227,882 | B1 * | 5/2001 | Ortega et al. | 439/101 |
| 6,293,827 | B1 | 9/2001 | Stokoe | 439/608 |
| 6,299,483 | B1 | 10/2001 | Cohen et al. | 439/608 |
| 6,302,711 | B1 | 10/2001 | Ito | 439/83 |
| 6,328,602 | B1 | 12/2001 | Yamasaki et al. | 439/608 |
| 6,379,188 | B1 | 4/2002 | Cohen et al. | 439/608 |
| 6,506,076 | B2 | 1/2003 | Cohen et al. | 439/608 |
| 6,540,522 | B2 | 4/2003 | Sipe | 439/61 |
| 6,572,409 | B2 | 6/2003 | Nitta et al. | 439/608 |
| 6,672,907 | B2 * | 1/2004 | Azuma | 439/682 |
| 6,692,272 | B2 | 2/2004 | Lemke et al. | 439/108 |
| 6,695,627 | B2 | 2/2004 | Ortega et al. | 439/78 |
| 6,736,664 | B2 | 5/2004 | Ueda et al. | 439/423 |
| 6,746,278 | B2 | 6/2004 | Nelson et al. | 439/608 |
| 6,749,439 | B1 | 6/2004 | Potter et al. | 439/65 |
| 6,764,341 | B2 | 7/2004 | Lappoehn | 439/608 |
| 6,808,420 | B2 | 10/2004 | Whiteman, Jr. et al. | 439/608 |
| 6,843,686 | B2 | 1/2005 | Ohnishi et al. | 439/608 |

(Continued)

*Primary Examiner*—Truc Nguyen
(74) *Attorney, Agent, or Firm*—Woodcock Washburn LLP

(57) ABSTRACT

An electrical connector comprises two signal contacts, each having an L-shaped body portion, a first contact arm connected to a first end of the L-shaped body portion, and a second contact arm also connected to the first end of the L-shaped body portion. For each signal contact, the first contact arm and the second contact arm define a plug contact receiving space therebetween, and the L-shaped body extends from a first end to a second end opposite the first end. The signal contacts are positioned so that an edge of each of the L-shaped bodies is proximate and opposite the edge of the other signal contact, thereby electrically edge coupling the contacts. The edges of the L-shaped bodies may extend along the entire length of the bodies and along the contact arms, thereby providing electrical edge coupling throughout the length of the contact.

24 Claims, 11 Drawing Sheets

U.S. PATENT DOCUMENTS

| | | | | |
|---|---|---|---|---|
| 6,851,980 | B2 | 2/2005 | Nelson et al. | 439/608 |
| 6,893,686 | B2 | 5/2005 | Egan | 427/496 |
| 6,913,490 | B2 | 7/2005 | Whiteman, Jr. et al. | 439/608 |
| 6,918,789 | B2 | 7/2005 | Lang et al. | 439/608 |
| 6,981,883 | B2 | 1/2006 | Raistrick et al. | 439/74 |
| 6,988,902 | B2 | 1/2006 | Winings et al. | 439/79 |
| 7,021,975 | B2 | 4/2006 | Lappohn | 439/733.1 |
| 7,094,102 | B2 | 8/2006 | Cohen et al. | 439/608 |
| 7,108,556 | B2 | 9/2006 | Cohen et al. | 439/608 |
| 2004/0235321 | A1 | 11/2004 | Mizumura et al. | 439/92 |
| 2005/0032401 | A1 | 2/2005 | Kpbayashi | 439/76.2 |
| 2005/0170700 | A1 | 8/2005 | Shuey et al. | 439/701 |
| 2005/0196987 | A1 | 9/2005 | Shuey et al. | 439/108 |
| 2005/0215121 | A1 | 9/2005 | Tokunaga | 439/608 |
| 2005/0227552 | A1 | 10/2005 | Yamashita et al. | 439/862 |
| 2006/0024983 | A1 | 2/2006 | Cohen et al. | 439/61 |
| 2006/0068641 | A1 | 3/2006 | Hull et al. | 439/608 |
| 2006/0073709 | A1 | 4/2006 | Reid | 439/65 |
| 2006/0228912 | A1 | 10/2006 | Morlion et al. | 439/65 |
| 2006/0232301 | A1 | 10/2006 | Morlion et al. | 326/126 |

* cited by examiner

EDGE AND BROADSIDE COUPLED CONNECTOR

CROSS REFERENCE TO RELATED APPLICATIONS

The present application is related by subject matter to U.S. patent application Ser. No. 11/368,211 filed on Mar. 3, 2006 and titled "HIGH-DENSITY ORTHOGONAL CONNECTOR," U.S. patent application Ser. No. 11/367,745 filed on Mar. 3, 2006 and titled "ELECTRICAL CONNECTORS," and U.S. patent application Ser. No. 11/367,744 filed on Mar. 3, 2006 and titled "BROADSIDE-TO-EDGE-COUPLING CONNECTOR SYSTEM," the contents of which are hereby incorporated by reference in their entireties.

FIELD OF THE APPLICATION

This application relates to electrical connectors, and more particularly, to high speed, shieldless electrical connectors.

BACKGROUND

Electrical connector systems often include a receptacle connector and a plug connector. The receptacle connector has a plurality of receptacle contacts for receiving a plurality of plug or pin contacts. The receptacle connector and plug connector are mated together to form a connector system. When the plug and receptacle connectors are mated, the plug contacts are inserted into the receptacle contacts and an electrical connection is formed between each plug contact and a corresponding receptacle contact.

A connector system often comprises a plurality of electrical contacts placed in close proximity. Contacts in close proximity sometimes exhibit electrical cross-talk which interferes with signal transmission. Therefore, it is desirable to minimize the crosstalk between contacts.

SUMMARY

Applicants disclose a shieldless electrical connector with L-shaped, mirror image signal contacts. The unique contact configuration allows single ended and differential signal transmission with minimal cross talk between adjacent contacts.

In an illustrative embodiment, an electrical connector comprises a first signal contact having an L-shaped body portion, a first contact arm connected to a first end of the L-shaped body portion, and a second contact arm also connected to the first end of the L-shaped body portion. The second contact arm is positioned at an angle with respect to the first contact arm.

The illustrative electrical connector further comprises a second signal contact likewise having an L-shaped body portion, a first contact arm connected to a first end of the L-shaped body portion, and a second contact arm also connected to the first end of the L-shaped body portion. The second contact arm is positioned at an angle with respect to the first contact arm.

With respect to each of the first signal contact and the second signal contact, the first contact arm and the second contact arm define a plug contact receiving space there between, and the L-shaped body extends from a first end to a second end opposite the first end.

For each of the first signal contact and the second signal contact, the L-shaped section comprises a first broadside portion having a first edge and a second broadside portion positioned at an angle relative to said first broadside portion. The first edge of the first signal contact is positioned proximate and opposite the first edge of the second signal contact, thereby electrically edge coupling (in the absence of a ground/reference plane) the contacts. Furthermore, the edges of the L-shaped body may extend along the entire length of the body and along one of the contact arms. Thus, the edge coupling may span the entire length of the connector.

For each of the first signal contact and the second signal contact, the second broadside portion may be positioned at approximately 90 degrees relative to the first broadside portion. The second broadside portions of the first signal contact and the second signal contact are generally parallel to each other and provide electrical broadside coupling (in the absence of a ground/reference plane) between the two contacts.

An illustrative connector may further comprise a plug portion comprising a first plug contact and a second plug contact. Each of the plug contacts comprise a leverage arm that has an edge. The edge of the leverage arm of the first plug contact is positioned proximate and opposite the edge of the leverage arm of the second plug contact, thereby resulting in electrical edge coupling between the plug contacts. The first plug contact is interfaced with the first signal contact and the second plug contact is interfaced with the second signal contact. The edges of the leverage arms of the first and second plug contacts extend at least to the edges of the first and second signal contacts respectively. The juxtaposition of edges in the signal contact and the plug contact results in edge coupling through the entire length of the connector path, i.e. across the receptacle contact and into the plug contact.

The first arm and the second arm of the signal contacts may have contact points or tips for interfacing with the plug contacts. When the plug contacts are positioned in the recess formed between the arms, the contact points form a physical and electrical contact with the plug contact. The first arm and second arm of each of the signal contacts may be disposed at substantially 90 degrees relative to each other. The plug contacts may be inserted into the recess such that a broadside of the contact is positioned at substantially 45 degrees relative to contact arms.

The signal contacts may be formed in insert molded lead frame assemblies (IMLA). Adjacent contacts in adjacent IMLAs can be designated as differential pairs, differential pairs separated by ground pairs, single ended ground-signal-ground configurations, signal-ground-signal configurations, or other suitable arrangements. The L-shaped contacts may be positioned very close together, e.g. such as an estimated 0.3-0.4 mm separation in air and an estimated separation of approximately 0.4-0.8 mm in plastic, so that one broadside portion of each L-shape contact is electrically edge coupled to an adjacent L-shaped contact. The edge-coupled portions of adjacent contacts lie generally in a first imaginary plane, and the remaining broadside contact portions lie in generally parallel imaginary planes that are transverse to the first imaginary plane. The two contact portions that lie in the generally parallel imaginary planes may terminate in board mount, such as a press-fit pin or a BGA surface mount. The geometry of the contacts allows two complementary contacts within a mated differential pair to have the same overall length, which reduces signal skew. In addition, the signal contacts may form a female mating interface without flair, and the mounting ends of the contacts may be formed so as to accommodate PCB vias and trace routing. The offset contact arms create a tuning fork mating interface with two opposed contact points that provide a consistent and effective physical and electrical connection with plug contacts oriented more or less than 90 and 180 degrees with respect to imaginary x-y axes intersecting at a center origin of the plug body.

An illustrative connector may operate above a 1.5 Gigabit/sec data rate, and preferably above 10 Gigabit/sec, such as at 250 to 30 picosecond rise times. Crosstalk between differential signal pairs may be generally six percent or less. Impedance may about 100±10 Ohms. Alternatively, impedance may be about 85±10 Ohms. There are preferably no shields between differential signal pairs. Air or plastic can be used as a dielectric material.

Additional features of illustrative embodiments are described below.

BRIEF DESCRIPTION OF THE DRAWINGS

The foregoing summary and the following additional description of the illustrative embodiments may be better understood when read in conjunction with the appended drawings. The potential embodiments of the disclosed systems are not limited to those depicted.

In the drawings.

DETAILED DESCRIPTION OF ILLUSTRATIVE EMBODIMENTS

Figure 1:
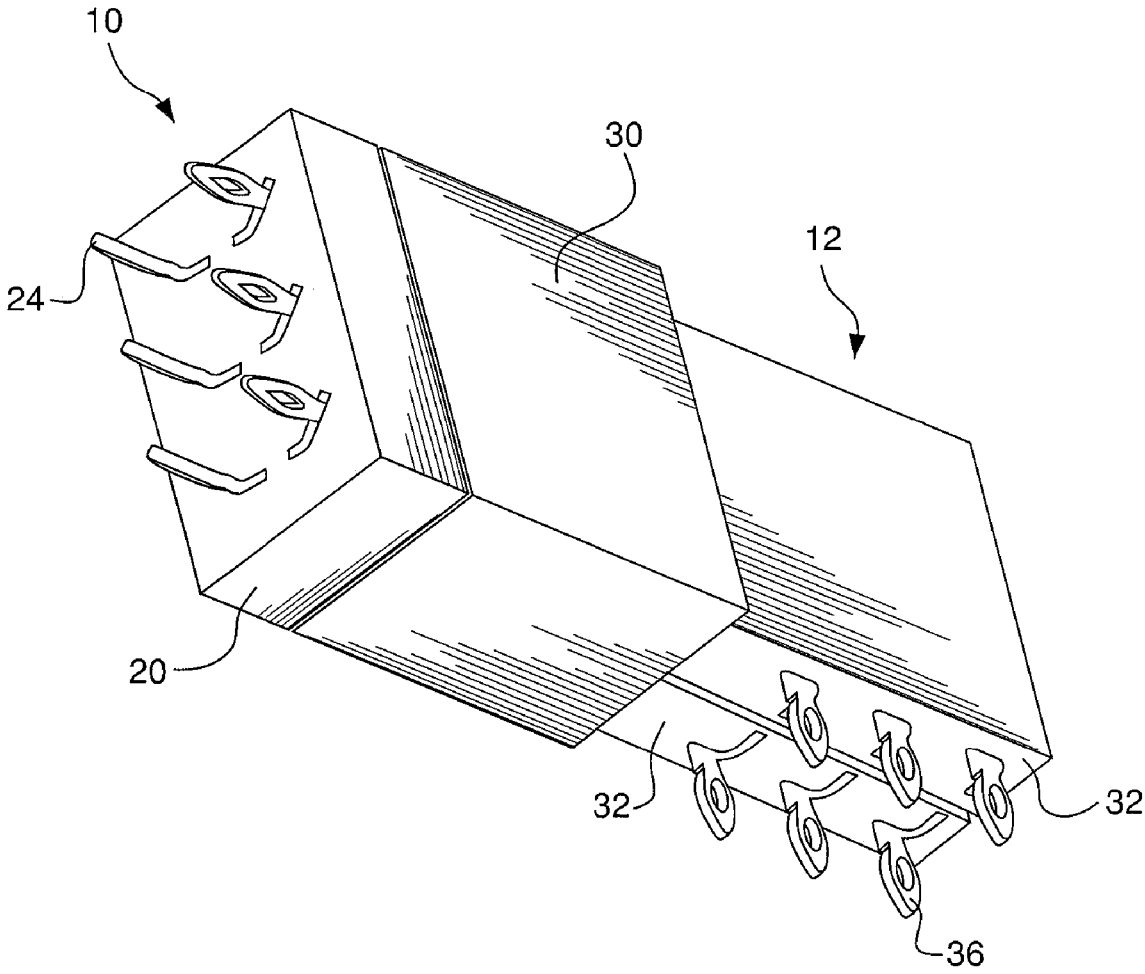
FIG. 1 is a perspective view an illustrative electrical connector system.
Figure 2:
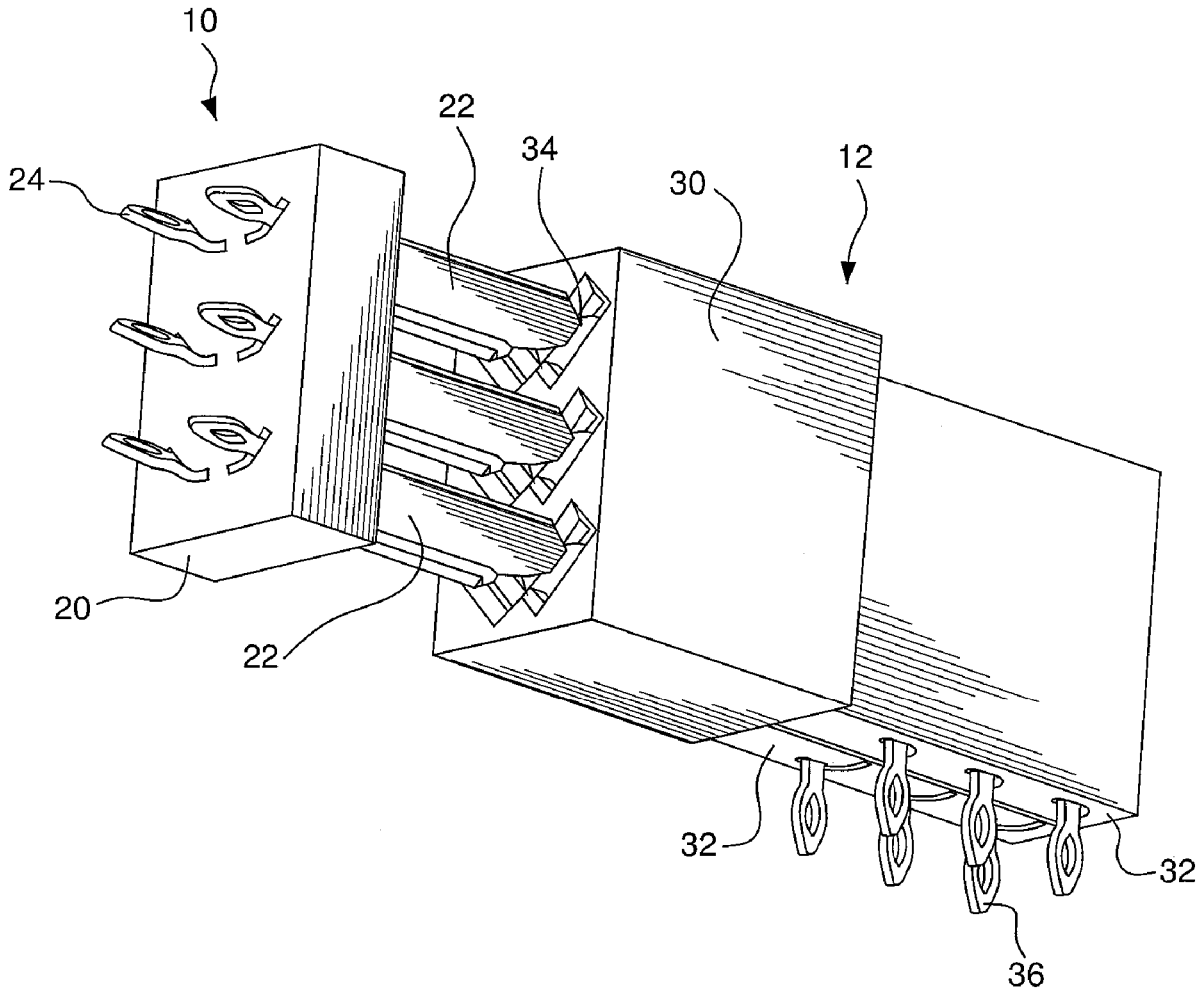
FIG. 2 is a perspective view of an illustrative electrical connector system with an electrical plug aligned for insertion into a receptacle.

FIGS. 1 and 2 provide perspective views of an illustrative electrical connector system comprising plug 10 and receptacle 12. As shown in FIG. 1, plug 10 is fully inserted into receptacle 12. In FIG. 2, plug 10 is aligned for insertion into receptacle 12. Plug 10 and receptacle connector 12 may be used to make electrical interconnections between printed circuit boards, backpanel applications, or other suitable electronic systems or devices.

Plug 10 comprises plug housing 20 and a plurality of plug contacts 22 (FIG. 2). Plug contact tails 24 extend from a side of housing 20 and are suitable for electrical connection with an electronic system such as, for example, a printed circuit board or functionally similar device.

Receptacle 12 comprises receptacle housing 30, a plurality of receptacle electrical contacts (not shown), and insert molded-lead frame assemblies 32. Receptacle housing 30 has a plurality of apertures 34 formed therein. A plurality of receptacle electrical contacts (not shown) are positioned, at least in part, in apertures 34 (FIG. 2). When plug 10 is inserted into receptacle 12, plug contacts 22 are inserted into apertures 34 and interface with receptacle electrical contacts. Receptacle electrical contact tails 36 extend from a side of contact modules 32 and are suitable for electrical connection with an electronic system such as, for example, a printed circuit board or functionally similar device.

Figure 3:
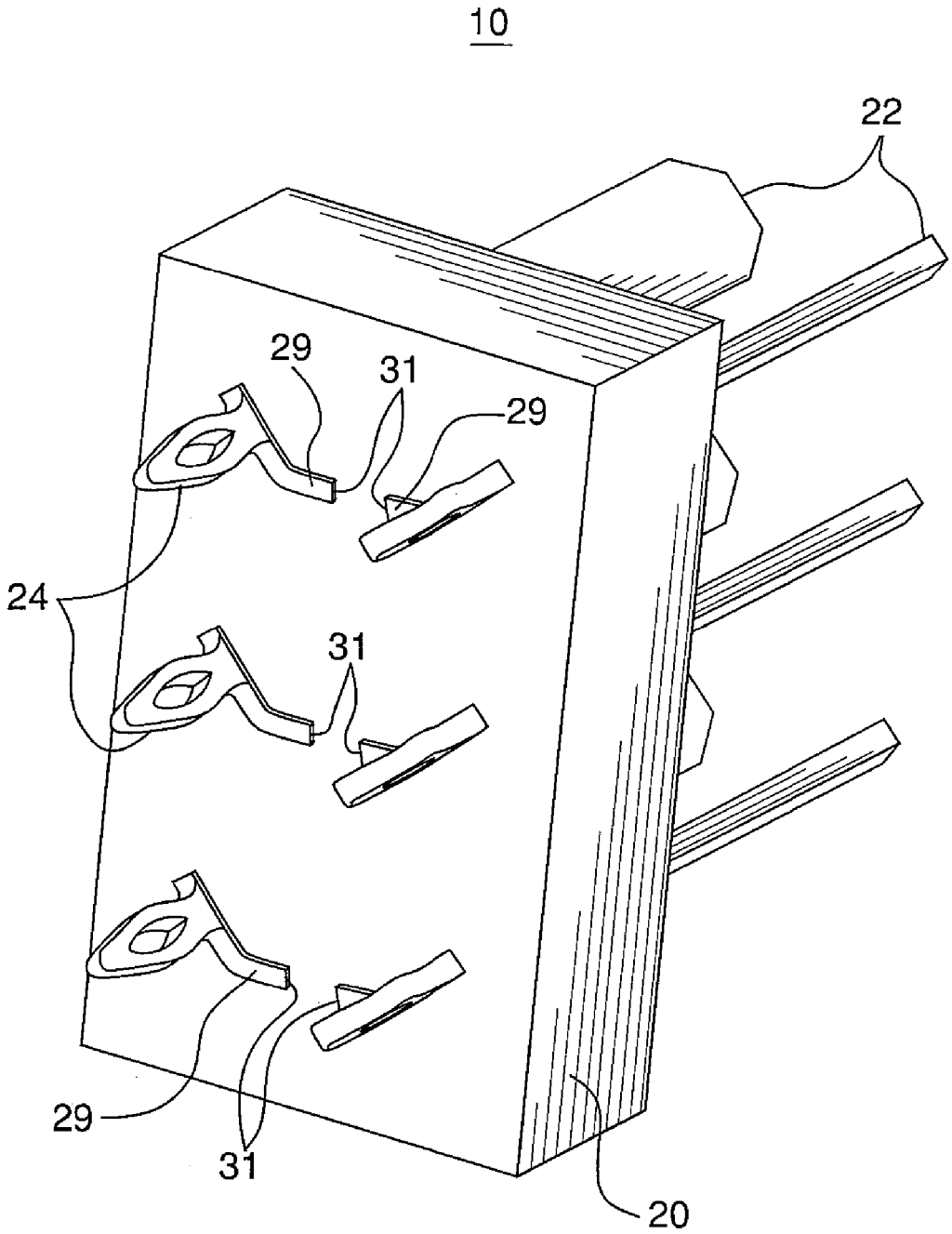
FIG. 3 is a perspective view of an illustrative plug.
Figure 4:
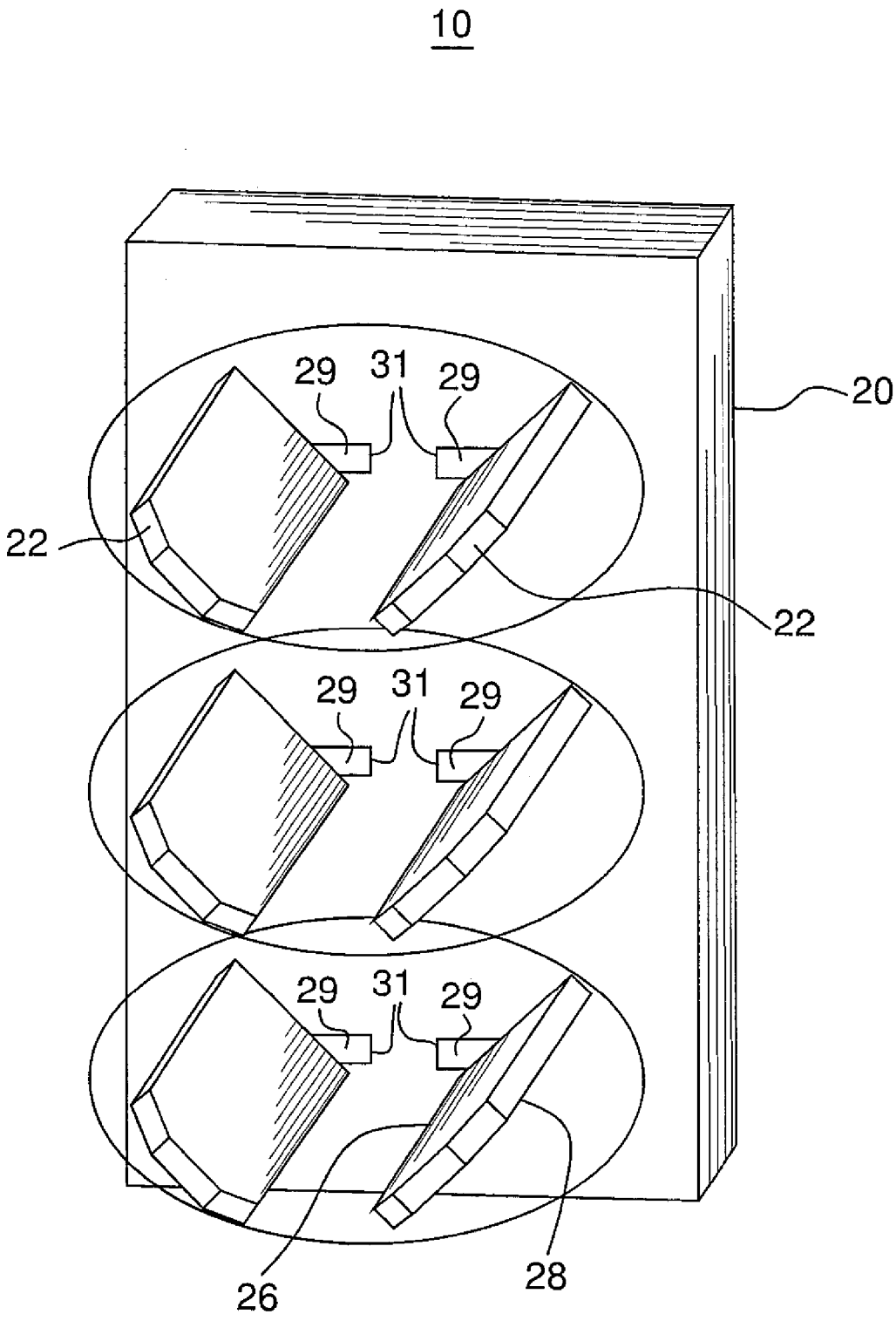
FIG. 4 is a perspective view of an illustrative plug.

FIGS. 3 and 4 provide isolated perspective views of plug 10. As shown, a plurality of plug contacts 22 extend from a side of plug housing 20. Plug contact tails 24 (FIG. 3) extend from another side of housing 20. Each plug contact 22 comprises a first substantially flat broadside surface 26 and a second substantially broadside flat surface 28. The first substantially flat, elongated surface 26 and second substantially flat, elongated surface 28 form opposing sides of contacts 22, and extend substantially parallel to each other. In an embodiment, elongated broadside surfaces 26, 28 of plug contacts 22 may be about 0.2-0.9 mm wide, and may have a thickness of about 0.2-0.7 mm. Plug contacts 22 comprise an arm 29 for receiving a force to insert contact 22 into housing 20. Arms 29 extend at least through housing 20. Arms 29 have edges 31, and as shown in FIGS. 3 and 4, edges 31 of adjacent contacts 22 may be positioned proximate and opposite each other. In other words, arms 29 of adjacent contacts 22 may be tightly electrically edge coupled so as not to require electrical shielding to prevent/minimize crosstalk. Further, and as described in connection with FIG. 11, when plug contacts 22 are interfaced with receptacle contacts 42, edges 31 of contacts 22 may extend to at least the ends of receptacle contacts 42 so as to provide electrical edge coupling across the entire length of the communication path.

Referring to FIGS. 3 and 4, housing 20 may be manufactured from any suitable material such as, for example, a high temperature thermoplastic or functionally similar material. Plug contacts 22 may be formed from a conducting material such as, for example, phosphor bronze or beryllium copper.

In an exemplary embodiment, three pairs of plug contacts 22 extend from housing 20. As shown, in an embodiment, for each pair of plug contacts 22 (denoted by circles in FIG. 4), contacts 22 are disposed substantially 90 degrees relative to each other. However, other angles greater than 90 degrees and less than 90 degrees are contemplated. Each pair of contacts 22 may correspond to a differential pair of electrical signals. Those skilled in the art recognize that plug contacts 22 may be used to carry any electrical signals including ground signals. In an embodiment wherein the contacts are employed to communicate differential pair signals, it is believed that contacts 22 and 42 may carry 50 to 2000 (10-90 percent) picosend rise time signals and convey 1-10 Gigabit/sec of data without the use of internal crosstalk shields positioned between IMLA's 32 and without changing spacing between rows or columns of contacts. Alternatively, internal or external shielding may also be used. Multi-active, worst case cross talk is possibly six percent or less. Differential impedance is about 100 plus-or-minus 10 Ohms or 85 plus-or-minus 10 Ohms.

Figure 5:
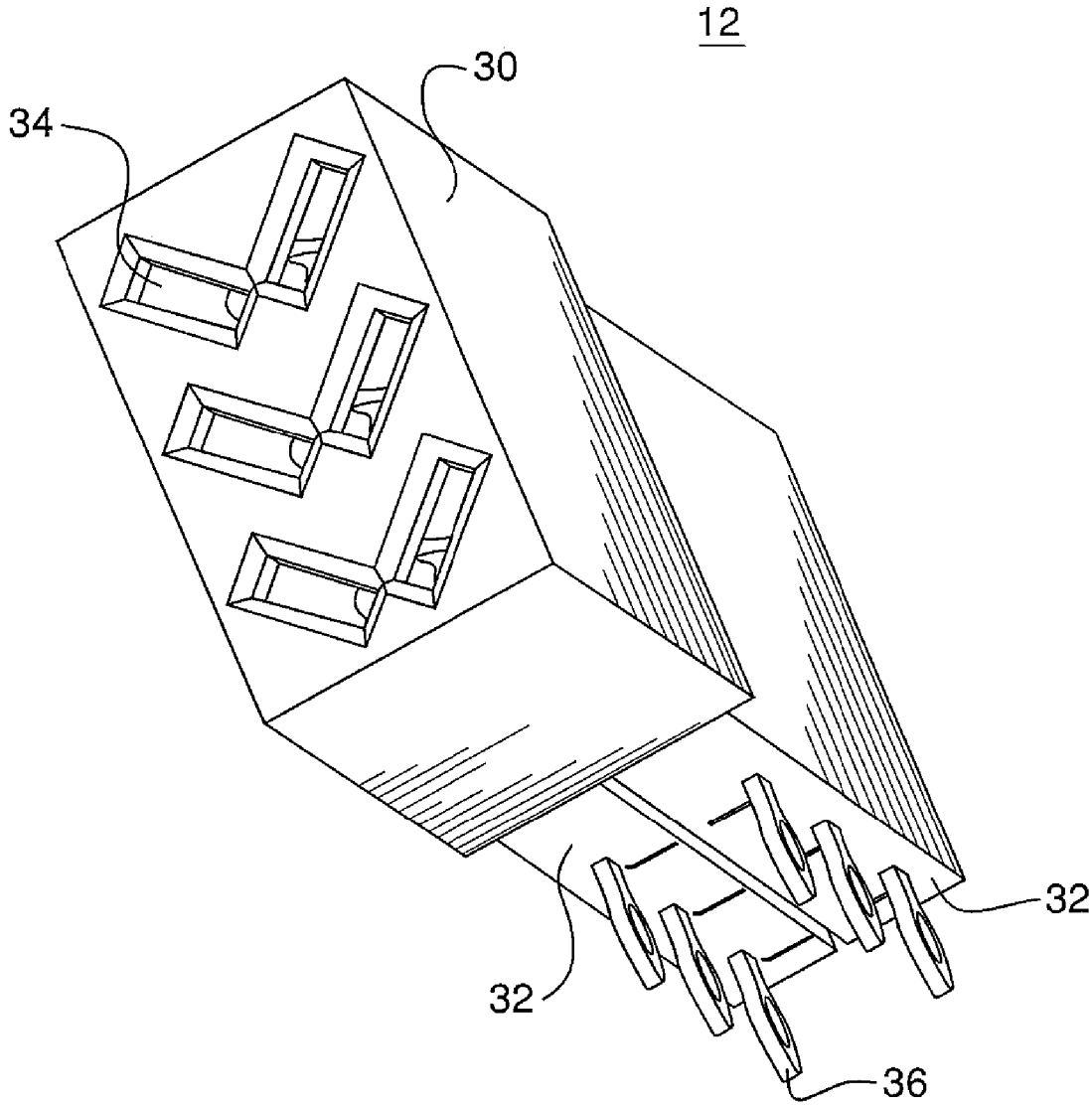
FIG. 5 is a perspective view of an illustrative receptacle connector.
Figure 6:
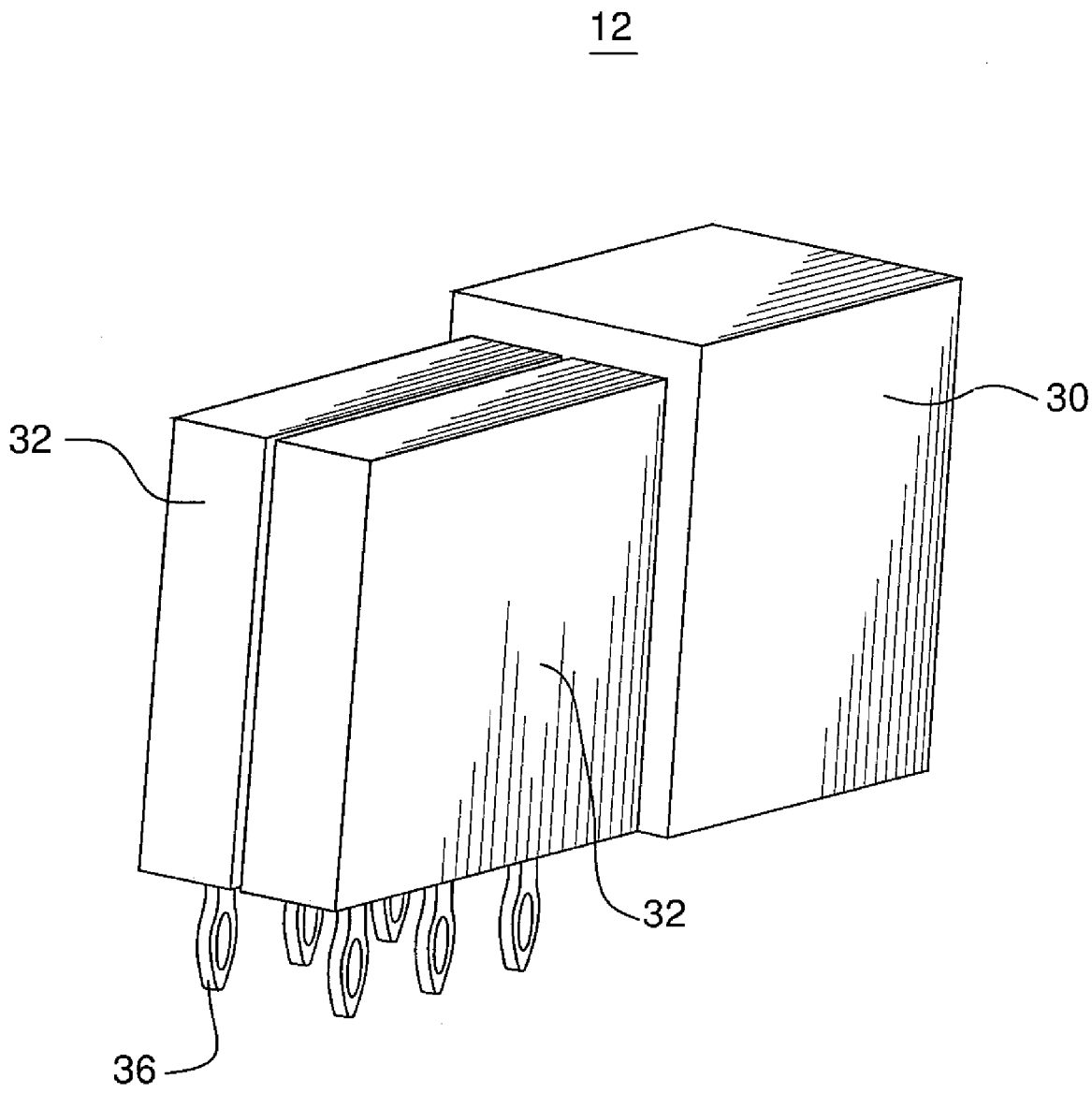
FIG. 6 is a perspective view of an illustrative receptacle connector.

FIGS. 5 and 6 provide perspective views of receptacle connector 12. As shown, receptacle housing 30 has a plurality of apertures 34 formed therein for accepting plug contacts 22 (FIG. 4). Receptacle electrical contacts are situated in apertures 34 of housing 30 and interface with plug contacts 22 upon insertion of plug 10 into receptacle 12. The plurality of apertures 34 extend through housing 30 and accept a portion of receptacle electrical contacts that extend from IMLAs 32. Receptacle housing 30 may be manufactured from a plastic material such as a high temperature thermoplastic or any other suitable material.

Figure 7:
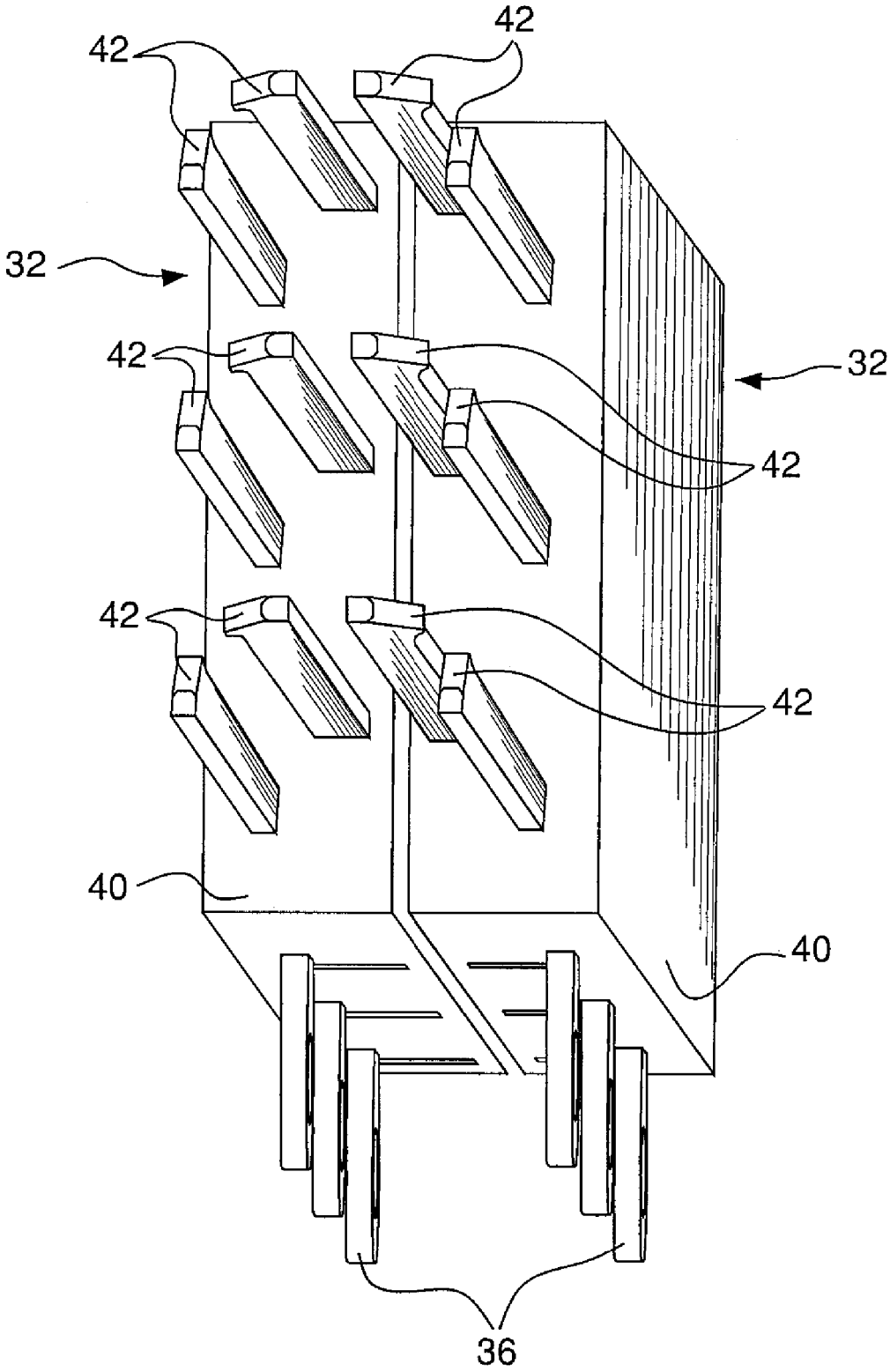
FIG. 7 is a perspective view of an illustrative insert molded lead frame assemblies.

FIG. 7 provides a perspective view of two receptacle IMLAs 32. As shown, in an illustrative embodiment, each of modules 32 comprises a module body 40 and a plurality of arm portions of receptacle electrical contacts 42 that extend there from. Receptacle electrical contacts 42 are aligned with apertures 34 (FIG. 5) formed in receptacle housing 30. Receptacle electrical contacts 42 may be arranged in rows in body 40. Receptacle electrical contact tails 36 extend from a different side of module body 40 and may have any configuration and composition suitable for connection to an electrical system or device, such as a BGA or press fit. Receptacle electrical contacts 42 may be formed from a conducting material such as, for example, phosphor bronze or beryllium copper. The receptacle contacts may have a material thickness of about 0.2 to 0.7 mm, and the distance between contact arms (discussed below) is approximately equal to the material thickness of the associated plug contact 22. Module body 40 may be manufactured from any suitable material such as, for example, high temperature thermoplastic or similar material.

Figure 8:
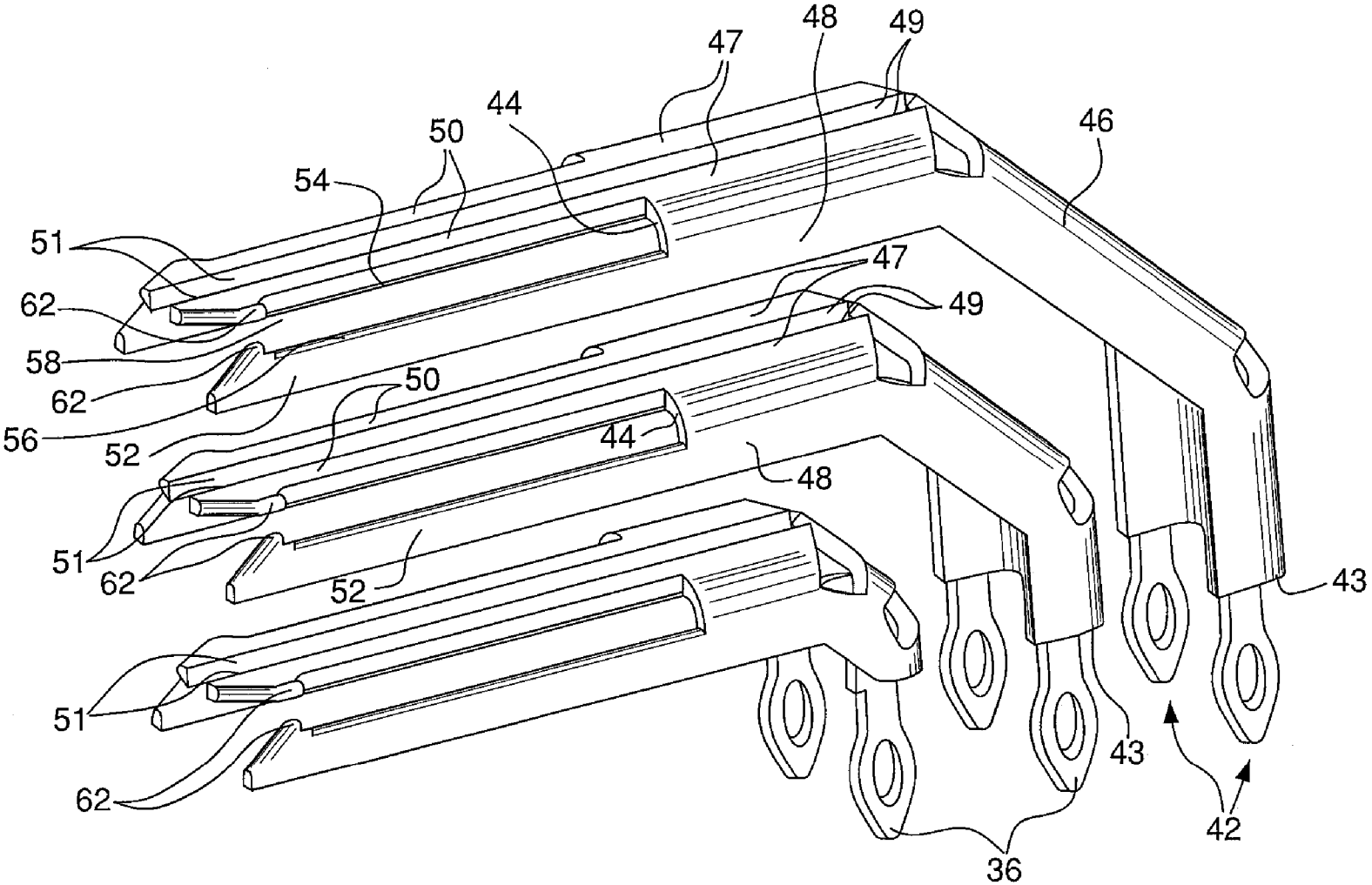
FIG. 8 is a perspective view of a plurality of illustrative receptacle lead frames.
Figure 9:
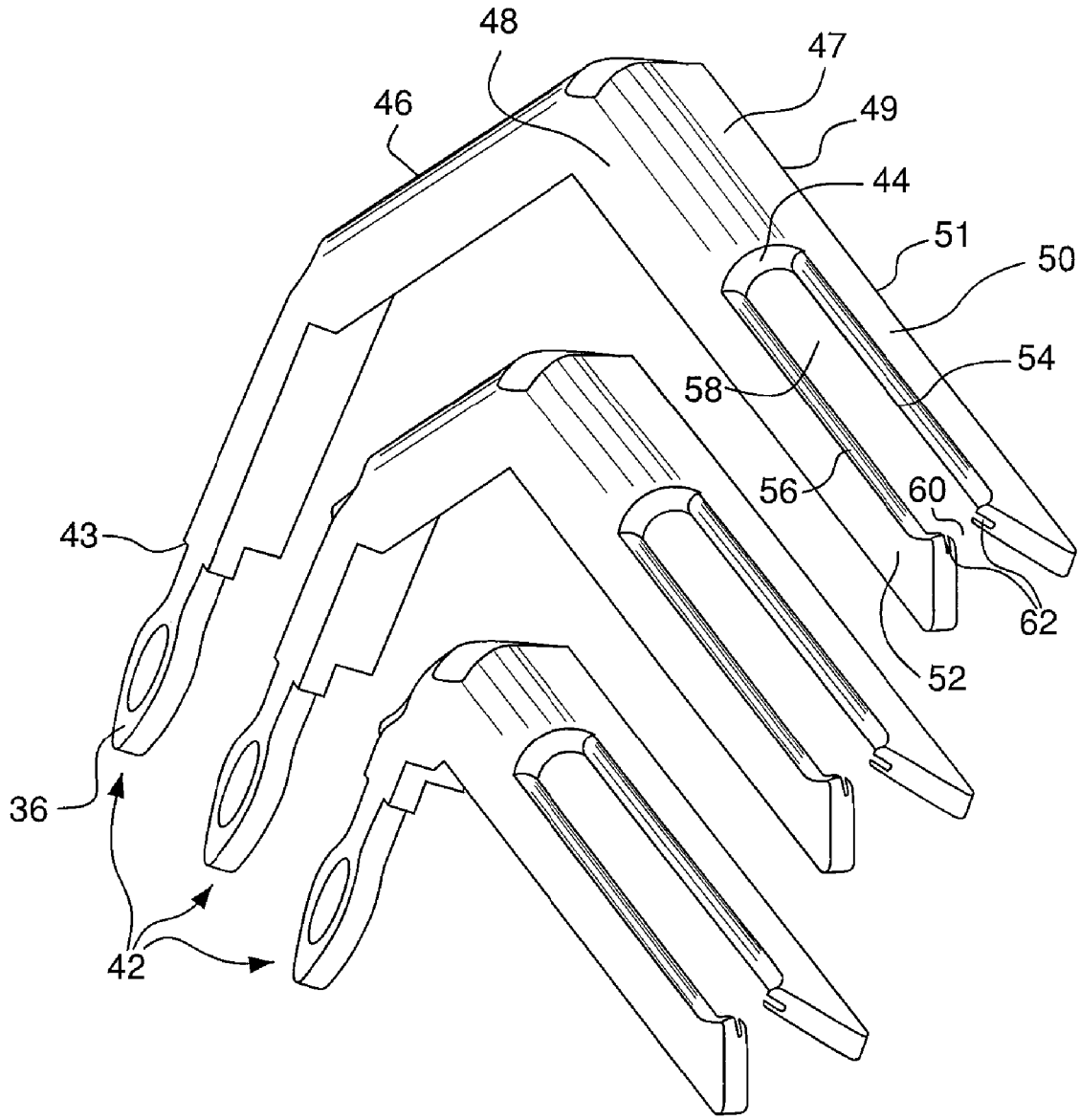
FIG. 9 is a perspective view of a plurality of illustrative receptacle lead frames.

FIG. 8 provides an isolated perspective view of several receptacle electrical contacts 42 without module bodies 40. It is contemplated that potential embodiments may use plastic or air as a dielectric. FIG. 9 provides an isolated perspective view of three receptacle electrical contacts 42 without module body 40. Each receptacle electrical contact 42 comprises contact tail 36 and body or base portion 46. Body portion 46 may be generally L-shaped from a first end 43 to a second end 44. In other words, body portion 46 may comprise a first broadside portion 47 and a second broadside portion 48. The broadside portions 47, 48 may be formed at approximately 90 degrees relative to each other so as to form an L-shape cross section. The contacts 42 may be positioned in pairs so that each contact 42 in an IMLA 32 has a corresponding contact 42 in an adjacent IMLA 32. The L-shaped contacts may be positioned very close together, e.g., with an approximate 0.3-0.4 mm separation in air and an approximate 0.4-0.8 mm separation in plastic. The contact pairs may be employed to carry numerous signal types including, for example, differential pairs. Further, the contacts may be positioned such that an edge 49 of the first broadside portion 47 is positioned opposite and adjacent to edge 49 of the first broadside portion 47 of an adjacent contact 42. The adjacent edges 49 provides for electrical edge coupling between the adjacent signal contacts 42 from the first end 43 to the second end 44 of the signal contact 42. Furthermore, second broadside portion 48 in adjacent contact signals 42 are generally formed in parallel, but offset planes and thereby provide electrical broadside coupling through the length of body 46.

Projecting from interface body 46 are a first electrical contact arm 50 and a second electrical contact arm 52. Electrical contact arms 50, 52 each have a length dimension and a width dimension. Electrical contact arms 50, 52 extend substantially parallel in a lengthwise direction (i.e., a first dimension) from body 46. With respect to the width dimension (i.e., a second dimension), contact arms 50 and 52 extend transverse to one another, such as, for example, approximately 90 degrees relative to each other. A first electrical contact arm 50 may have an edge 51 that is positioned opposite and proximate to the corresponding edge 51 in the adjacent signal contact 42. Edge 51 may be a continuation of edge 49 formed in first broadside portion 47 of body 46. Thus, the electrical edge coupling between adjacent contacts 42 may extend from first end 43 to the end of contact arm 50. Furthermore, second contact arm 52 may be formed parallel to and integral with second broadside portion 48 of base 46 and thereby continue the electrical broadside coupling provided by broadside portion 48 from beginning end 43 to the end of contact arm 52.

Contact arms 50 and 52 of receptacle electrical contacts 42 comprise elongated minor surface 54 and 56, respectively. Elongated minor surfaces 54 and 56 extend substantially parallel to each other in a lengthwise dimension from interface base 48. In one embodiment, elongated minor surface 54 and 56 comprise edges of arms 50 and 52. Elongated minor surfaces 54 and 56 define a recess 58 there between, with an opening 60 located at one end and interface base 48. Arms 50, 52 may have contact tips or points 62 projecting from surfaces 54, 56 for enhancing the physical and electrical interface between arms 50, 52 and plug contacts 22. Recess 58 is of sufficient width to accommodate therein the width of plug contact 22.

Figure 10:
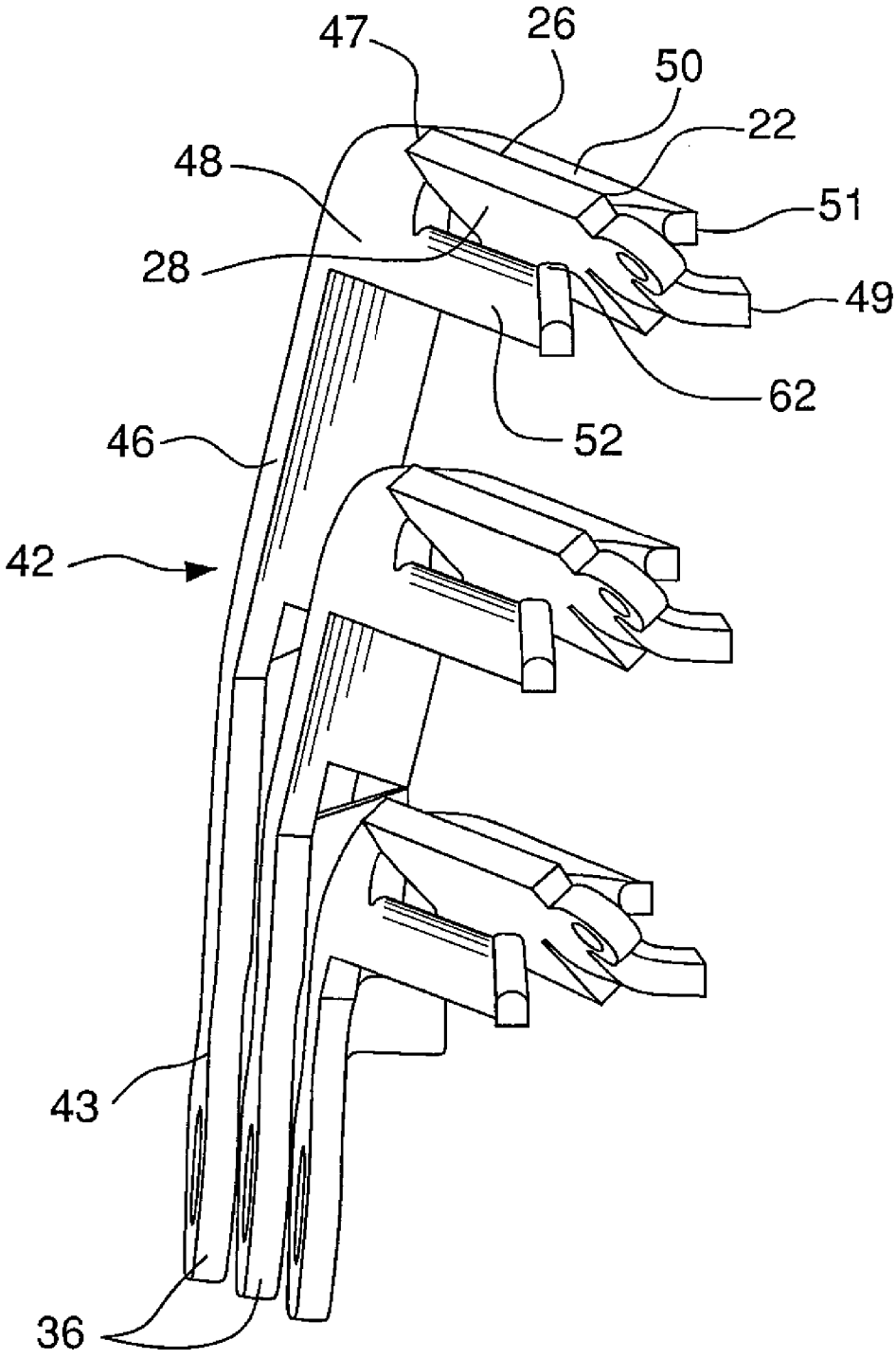
FIG. 10 is a perspective view of a plurality of illustrative receptacle contacts with plug contacts interfaced therewith.
Figure 11:
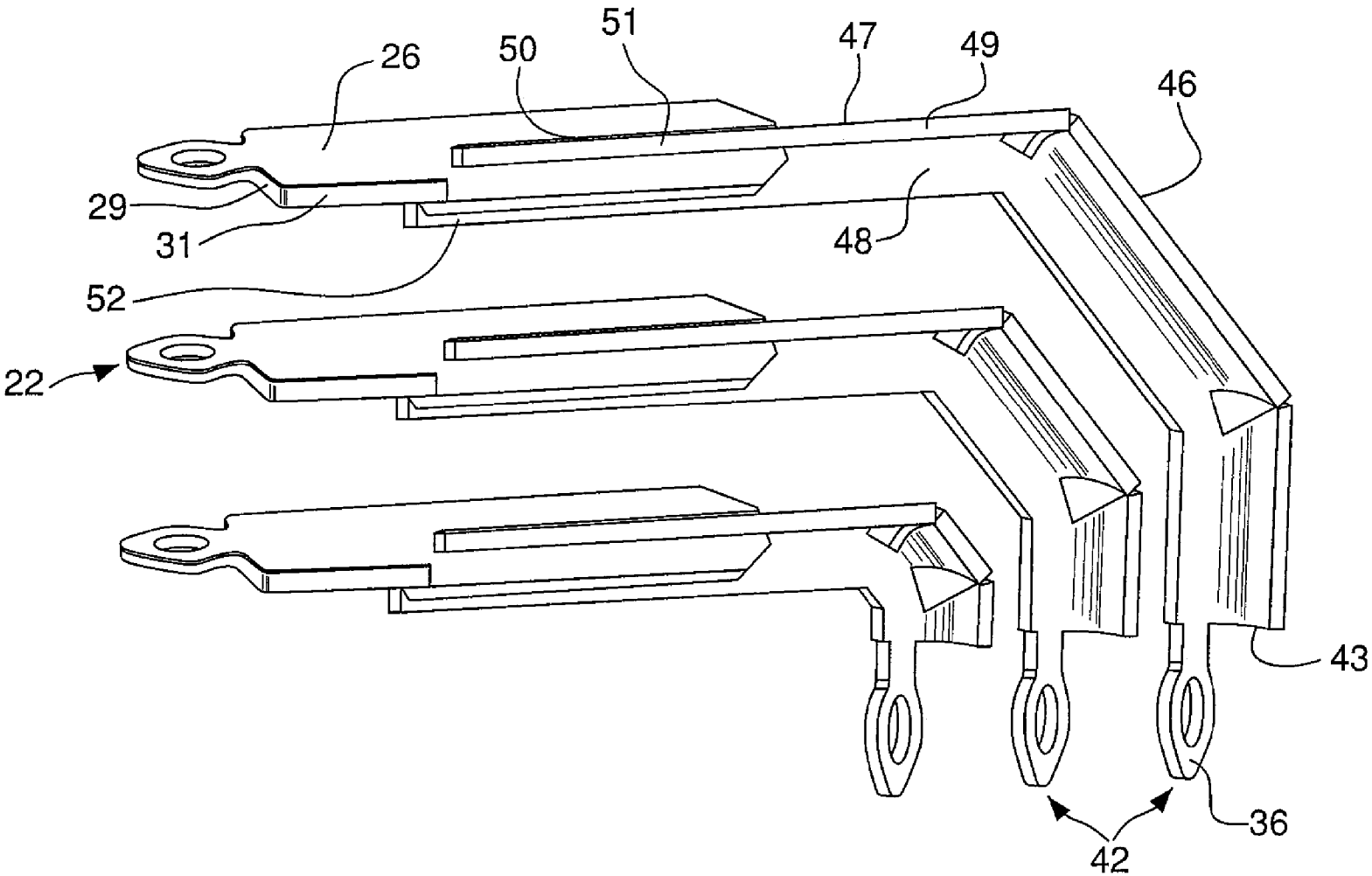
FIG. 11 is a sectional view of the receptacle contacts shown in FIG. 10.

FIG. 10 provides an isolated perspective view of plug contacts 22 interfaced with receptacle electrical contacts 42. FIG. 11 shows plug contacts 22 interfaced with receptacle electrical contacts 42. Plug contacts 22 are inserted into recess 58 formed between first minor surface 54 and second minor surface 56. For each receptacle electrical contact 42, contact tips 62 interface with substantially flat surface 26 and second substantially flat surface 28 of plug contacts 22. Thus, a point of contact 62 is provided on each of opposing sides 26 and 28 of plug contacts 22 and thereby provides a dependable and consistent electrical connection. In the embodiment depicted in FIG. 10, plug contacts 22 are positioned substantially at 45 degrees relative to the first contact arm 50, second contact arm 52. Other angles greater than zero degrees and less than ninety degrees may be employed.

Leverage arm 29 and its edge 31 of plug contact 22 may extend at least as far as contact arm 50, and may overlap with contact arm 50 and edge 51. This juxtaposition or overlapping of edges 31 and 51 provides electrical edge coupling across the length of the electrical interface.

Thus, applicants have disclosed an electrical connector that provides for electrical edge coupling between adjacent contacts. The electrical edge coupling may be carried from a first end of the receptacle connector to the opposing tip of the receptacle. Electrical broadside coupling may also be provided from the first end to the opposing tip of the receptacle. Furthermore, electrical edge coupling may be carried through the receptacle and plug interface by positioning or overlapping edges. An illustrative embodiment may greatly reduce the crosstalk (to less than or equal to 6%) at high data rates with low signal rise times. Also, an illustrative embodiment may provide a consistent and reliable interface between plug and receptacle contacts.

It is noted that the foregoing examples have been provided merely for the purpose of explanation and are in no way to be construed as limiting of the potential embodiments. While the embodiments have been described with reference to embodiments wherein the number and arrangement of electrical contacts is consistent for all interfaces, it is understood that the number and arrangement of electrical contacts may vary. For example, any number of electrical receptacle and plug contacts may be employed. Furthermore, the number, shape, and position of recesses formed may vary. Still further, the types of signals carried by the contacts and the specific implementation of the electrical contacts may vary. For example, the adjacent contacts may be designated as differential pairs, differential pairs separated by ground pairs, single ended ground-signal-ground configurations, signal-ground-signal configurations, or other suitable arrangements. Thus, although the embodiments have been described herein with reference to particular means, materials and embodiments, the potential embodiments are not intended to be limited to the particulars disclosed herein; rather, the potential embodiments extend to all functionally equivalent structures, methods and uses, such as are within the scope of the appended claims.

What is claimed is:

1. An electrical connector, comprising:

a first differential signal contact comprising an L-shaped body portion, a first contact arm connected to a first end of the L-shaped body portion, and a second contact arm connected to the first end of the L-shaped body portion and positioned at an angle with respect to the first contact arm, the first contact arm and the second contact arm defining a plug contact receiving space therebetween and the L-shaped body extending from a first end to a second end opposite the first end;

a second differential signal contact comprising an L-shaped body portion, a first contact arm connected to a first end of the L-shaped body portion, and a second contact arm connected to the first end of the L-shaped body portion and positioned at an angle with respect to the first contact arm, the first contact arm and the second contact arm defining a plug contact receiving space therebetween and the L-shaped body extending from a first end to a second end opposite the first end; and a plug portion comprising a first plug contact having two opposing substantially broadside surfaces for interfacing with said first differential signal contact, and a second plug contact having two opposing substantially broadside surfaces for interfacing with said second differential signal contact, wherein said two opposing broadside surfaces of said first plug contact are positioned at an angle with respect to the said two opposing broadside surfaces of said second plug contact.

2. The electrical connector as recited in claim 1, wherein the second differential signal contact is positioned adjacent to the first differential signal contact and is separated from the first differential signal contact by only a dielectric material.

3. The electrical connector as recited in claim 2, wherein the first and second differential signal contacts define an electrically edge coupled differential signal pair.

4. The electrical connector as recited in claim 3, wherein crosstalk between the first differential signal contact and the second differential signal contact is 6% or less when a 50-2000 (10-90) picosecond signal is transmitted through the differential signal pair.

5. The electrical connector as recited in claim 1, wherein the first and second differential signal contacts are the same length.

6. The electrical connector as recited in claim 1, wherein the electrical connector has no internal crosstalk shields.

7. The electrical connector as recited in claim 1, wherein a communication path exists between said plug portion and said first differential signal contact and said second differential signal contact, and further wherein said first differential signal contact and said first plug contact are electrically edge coupled with said second differential signal contact and said second plug contact across the entire length of the communication path.

8. The electrical connector as recited in claim 1, wherein for each of the first differential signal pair and the second differential signal pair, the L-shaped section comprises a first broadside portion having a first edge and a second broadside portion positioned at an angle relative to said first broadside portion.

9. The electrical connector as recited in claim 8, wherein the first edge of the first differential signal contact is positioned proximate and opposite to the first edge of the second differential signal contact.

10. The electrical connector as recited in claim 9, wherein the second broadside portion of the first differential signal contact is positioned substantially parallel to the second broadside portion of the second differential signal contact.

11. The electrical connector as recited in claim 9, wherein said first plug contact has a first leverage arm having an edge extending along the plug contact, and said second plug contact has a second leverage arm having an edge extending along the second plug contact, and further wherein said edge of the first leverage arm is positioned proximate and opposite to the edge of the second leverage arm.

12. The electrical connector as recited in claim 11, wherein the first edge of the first differential signal contact is parallel to the edge of said first leverage arm and said first edge of the second differential signal contact is parallel to the edge of said second leverage arm.

13. The electrical connector as recited in claim 12, wherein the first edge of the first differential signal contact extends at least to the edge of said first leverage arm, and the first edge of the second differential signal contact extends at least to the edge of said second leverage arm.

14. The electrical connector as recited in claim 13, wherein the first edge of the first differential signal contact extends from the second end of the L-shaped body through the first end of the L-shaped body and along the length of the first contact arm, and the first edge of the second differential signal contact extends from the second end of the L-shaped body through the first end of the L-shaped body and along the length of the first contact arm.

15. The electrical connector as recited in claim 11, wherein the first plug contact is positioned between the first contact arm and the second contact arm of the first differential signal contact, and the second plug contact is positioned between the first contact arm and the second contact arm of the second differential signal contact.

16. The electrical connector as recited in claim 15, wherein the first plug contact has a broadside that is positioned at substantially 45 degrees relative to the first broadside and second broadside of said first differential signal contact, and the second plug contact has a broadside that is positioned at substantially 45 degrees relative to the first broadside and second broadside of said second differential signal contact.

17. An electrical connector, comprising:

a first signal contact comprising a body having a first broadside portion having a first edge and a second broadside portion integrally formed with said first broadside portion and extending at an angle with respect to said first broadside portion, a first contact arm connected to a first end of the body, and a second contact arm connected to the first end of the body and positioned at an angle with respect to the first contact arm, the first contact arm and the second contact arm define a plug contact receiving space therebetween, and the first broadside portion and the second broadside portion extend from a first end of the body to a second end of the body;

a second signal contact comprising a body having a first broadside portion having a first edge and a second broadside portion integrally formed with said first broadside portion and extending at an angle with respect to said first broadside portion, a first contact arm connected to a first end of the body, and a second contact arm connected to the first end of the body and positioned at an angle with respect to the first contact arm, the first contact arm and the second contact arm define a plug contact receiving space therebetween, and the first broadside portion and the second broadside portion extend from a first end of the body to a second end of the body; and a plug portion comprising a first plug contact having two opposing substantially broadside surfaces for interfacing with said first signal contact and a second plug contact having two opposing substantially broadside surfaces for interfacing with said second signal contact, wherein said two opposing broadside surfaces of said first plug contact are positioned at an angle with respect to the said two opposing broadside surfaces of said second plug contact.

18. The system of claim 17, wherein the first edge of the first signal contact is positioned proximate and opposite to the first edge of the second signal contact.

19. The electrical connector as recited in claim 18, wherein said first plug contact has a first leverage arm having an edge extending along the plug contact, and said second plug contact has a second leverage arm having an edge extending along the second plug contact, and further wherein said edge of the first leverage arm is positioned proximate and opposite to the edge of the second leverage arm.

20. The electrical connector as recited in claim 19, wherein the first edge of the first signal contact is parallel to the edge of said first leverage arm and said first edge of the second signal contact is parallel to the edge of said second leverage arm.

21. The electrical connector as recited in claim 19, wherein the first edge of the first signal contact extends at least to the edge of said first leverage arm, and the first edge of the second signal contact extends at least to the edge of said second leverage arm.

22. The electrical connector as recited in claim 17, wherein for each of the first signal contact and the second signal contact, the second broadside portion is positioned at about 90 degrees relative to the first broadside portion.

23. The electrical connector as recited in claim 22, wherein for each of the first signal contact and the second signal contact, the first contact arm has a broadside and the second contact arm has a broadside, and further wherein the first broadside of the first contact arm is positioned at substantially 90 degrees relative to the broadside of the second contact arm.

24. The electrical connector as recited in claim 23, wherein the first plug contact has a broadside positioned at substantially 45 degrees relative to said first contact arm and the second contact arm of the first signal contact, and wherein the second plug contact has a broadside positioned at substantially 45 degrees relative to the first contact arm and the second contact arm of the second signal contact.

* * * * *